US011187493B1

(12) United States Patent
Teague et al.

(10) Patent No.: US 11,187,493 B1
(45) Date of Patent: Nov. 30, 2021

(54) HANDGUN OFFHAND FINGER REST APPARATUS

(71) Applicants: Jim Teague, Blanchard, ID (US); Denise Teague, Blanchard, ID (US)

(72) Inventors: Jim Teague, Blanchard, ID (US); Denise Teague, Blanchard, ID (US)

( * ) Notice: Subject to any disclaimer, the term of this patent is extended or adjusted under 35 U.S.C. 154(b) by 0 days.

(21) Appl. No.: 16/880,621

(22) Filed: May 21, 2020

(51) Int. Cl.
*F41C 23/10* (2006.01)

(52) U.S. Cl.
CPC ..... *F41C 23/10* (2013.01)

(58) Field of Classification Search
CPC ..... F41C 23/10; F41C 27/00
USPC ..... 42/90, 71.02
See application file for complete search history.

(56) References Cited

U.S. PATENT DOCUMENTS 2,899,767 A * 8/1959 Boudreau ..... F41A 19/10 42/75.01
2,903,810 A * 9/1959 Lewis ..... F41C 23/10 42/71.02
6,802,148 B1 10/2004 Danas
D664,234 S 7/2012 Nierenberg
9,194,649 B2 11/2015 Nierenberg
9,194,651 B2 11/2015 Nierenberg
10,066,900 B2 9/2018 Bowers
2016/0146573 A1* 5/2016 Kunkel ..... F41C 27/22 42/90
2017/0059272 A1* 3/2017 Gazes ..... F41C 33/041
2020/0271423 A1* 8/2020 Liu ..... F41C 27/00

FOREIGN PATENT DOCUMENTS

EP 2990753 8/2015

* cited by examiner

*Primary Examiner* — Reginald S Tillman, Jr.

(57) ABSTRACT

A handgun offhand finger rest apparatus for comfort and support when using the offhand for recoil management includes an attachment body having a body top side, a body bottom side, a body left side, a body right side, a body front side, and a body back side. The body top side is selectively engageable with an underside of a firearm in front of a trigger guard of the firearm. A thumb rest is coupled to the attachment body and perpendicularly extends from either the body left side or the body right side. A finger rest is coupled to the body bottom side of the attachment body adjacent the body back side to rest adjacent the trigger guard of the firearm.

11 Claims, 5 Drawing Sheets

HANDGUN OFFHAND FINGER REST APPARATUS

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to firearm offhand grip devices and more particularly pertains to a new firearm offhand grip device for comfort and support when using the offhand for recoil management.

(2) Description of Related Art Including Information Disclosed Under 37 CFR 1.97 and 1.98

The prior art relates to firearm offhand grip devices. Existing devices only serve to add a thumb grip and generally have an obtrusive profile occupying a portion of the side of the handgun. Such devices also incorporate multiple components and may require some assembly. Furthermore, these devices fail to serve a secondary purpose such as coupling with a holster.

(h) BRIEF SUMMARY OF THE INVENTION

An embodiment of the disclosure meets the needs presented above by generally comprising an attachment body having a body top side, a body bottom side, a body left side, a body right side, a body front side, and a body back side. The body top side is configured to be selectively engageable with an underside of a firearm in front of a trigger guard of the firearm. A thumb rest is coupled to the attachment body and perpendicularly extends from either the body left side or the body right side. A finger rest is coupled to the body bottom side of the attachment body adjacent the body back side and is configured to rest adjacent the trigger guard of the firearm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
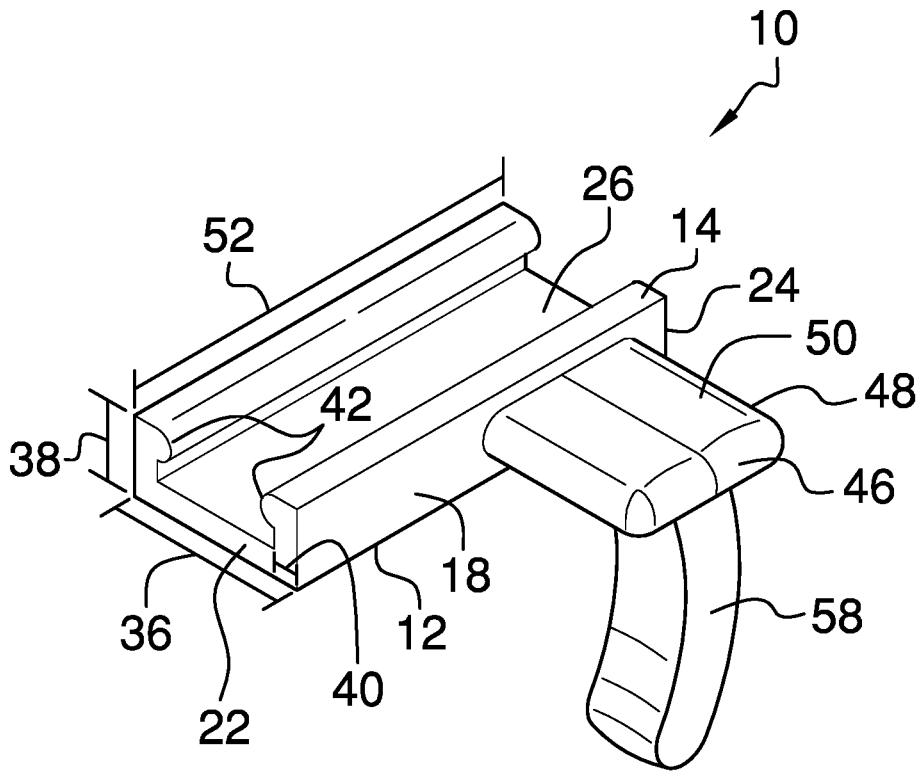
FIG. 1 is an isometric view of a handgun offhand finger rest apparatus according to an embodiment of the disclosure.
Figure 2:
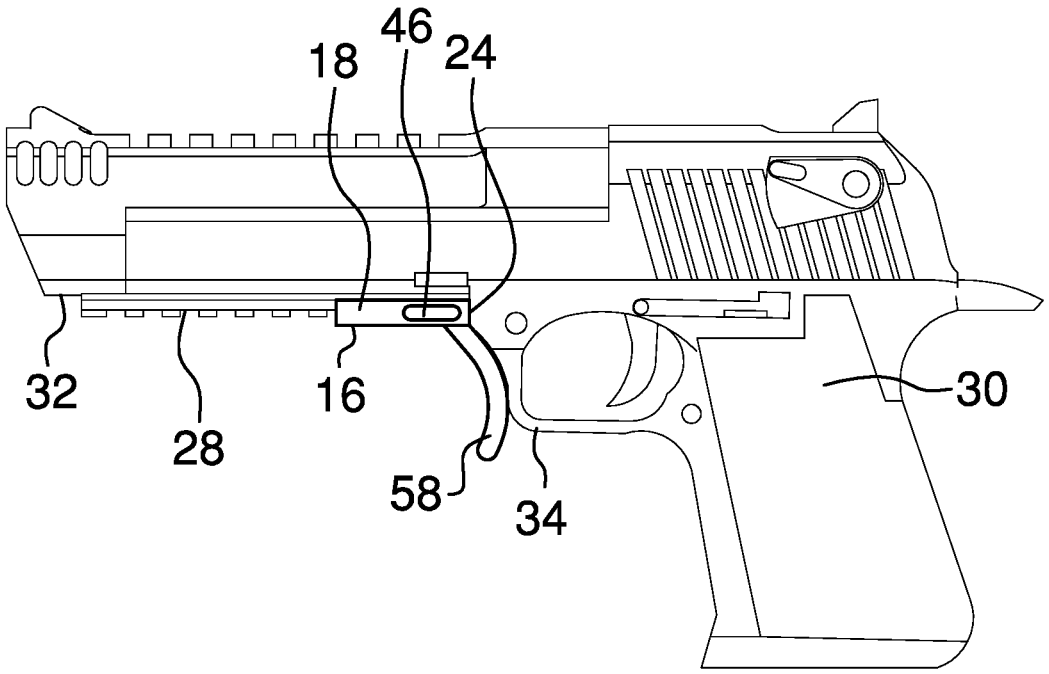
FIG. 2 is a side elevation view of an embodiment of the disclosure.

With reference now to the drawings, and in particular to FIGS. 1 through 6 thereof, a new firearm offhand grip device embodying the principles and concepts of an embodiment of the disclosure and generally designated by the reference numeral 10 will be described.

Figure 6:
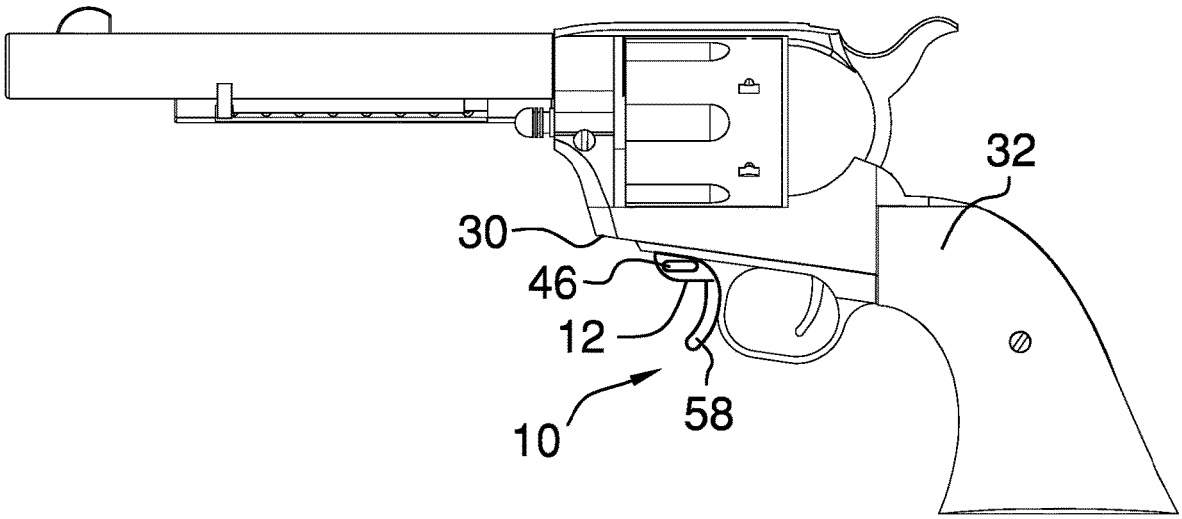
FIG. 6 is a side elevation view of an embodiment of the disclosure.

As best illustrated in FIGS. 1 through 6, the handgun offhand finger rest apparatus 10 generally comprises an attachment body 12 having a body top side 14, a body bottom side 16, a body left side 18, a body right side 20, a body front side 22, and a body back side 24. The body top side 14 may have a rail channel 26 extending from the body front side 22 to the body back side 24. The rail channel 26 is configured to selectively engage a rail system 28 on an underside 30 of a firearm 32 in front of a trigger guard 34 of the firearm. The rail system 28 may be one of, but not limited to, Picatinny rails, Weaver rails, dovetail rails, NATO accessory rails, and the like. The attachment body 12 may alternatively be configured to be bolted to the underside 30 of the firearm as shown in FIG. 6.

Figure 3:
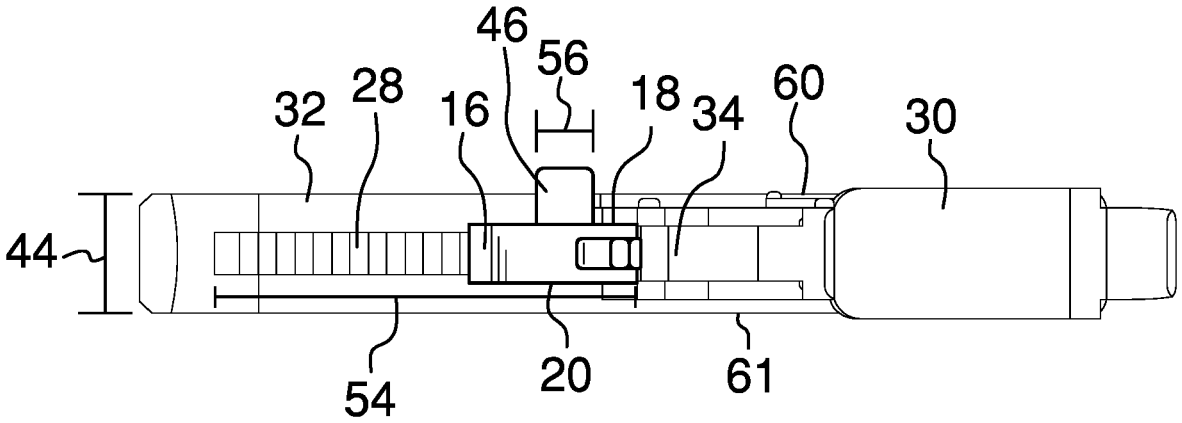
FIG. 3 is a bottom plan view of an embodiment of the disclosure.
Figure 4:
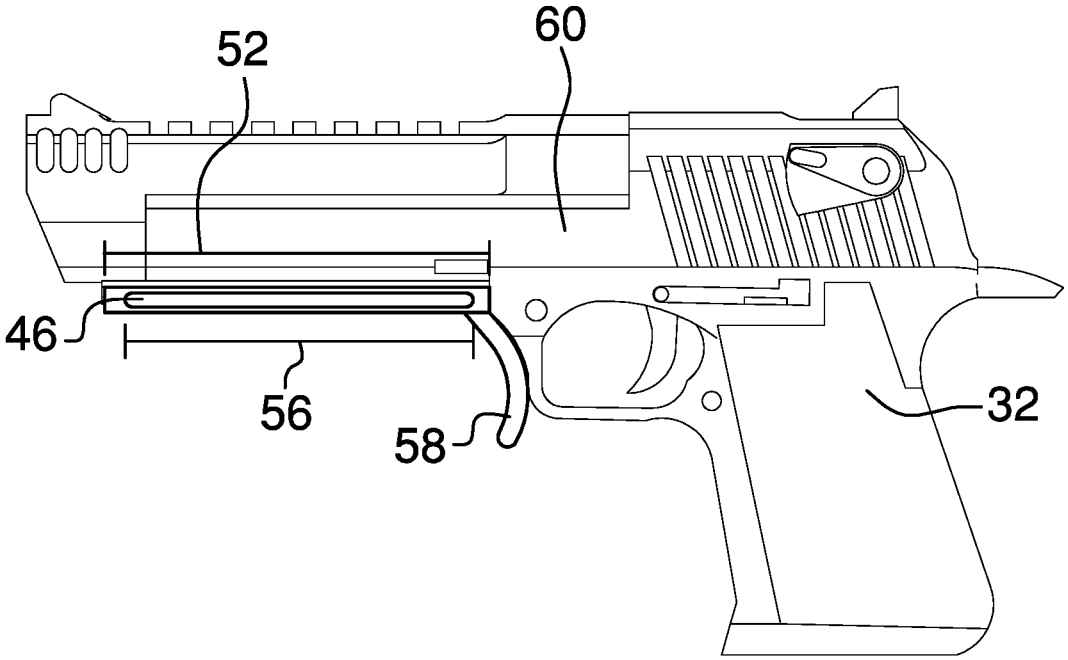
FIG. 4 is a side elevation view of an embodiment of the disclosure.
Figure 5:
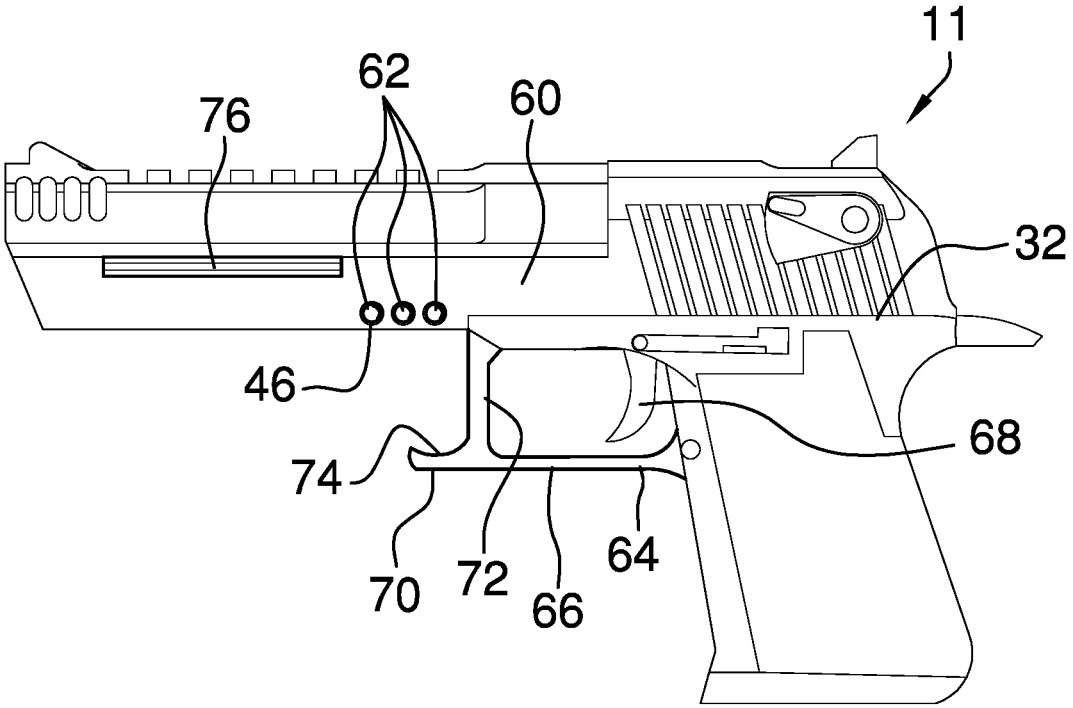
FIG. 5 is a side elevation view of an embodiment of the disclosure.

An attachment width 36 and an attachment depth 38 of the attachment body 12 define an attachment thickness 40 with the rail channel 26. The attachment thickness 40 may be uniform excepting a pair of rail protrusions 42 of the rail channel. The attachment body 12 may be produced with the minimum possible attachment depth 38 and attachment thickness 40 to create a sufficiently strong attachment thickness 40 depending on the material used. As shown in FIG. 3, the attachment width 36 is less than a firearm width 44 of the firearm.

A thumb rest 46 is coupled to the attachment body 12. The thumb rest 46 perpendicularly extends from either the body left side 18 or the body right side 20 to accommodate a righthanded or a lefthanded shooter, respectively. The thumb rest 46 may be rectangular prismatic with rounded edges for user comfort. A back thumb edge 48 and a top thumb side 50 of the thumb rest 46 may alternatively be contoured for ergonomic fit and comfort.

The thumb rest 46 may also be configured to slidably engage a locking channel of a holster. The attachment body 12 may have an attachment length 52 configured to conform to a rail length 54 of the rail system of the firearm to maximize a thumb length 56 of the thumb rest 46. The thumb length 56 may be equal to at least 75% of the attachment length 52.

A finger rest 58 is coupled to the attachment body 12. The finger rest 58 is coupled to the body bottom side 16 adjacent the body back side 24 and is configured to rest adjacent the trigger guard 34 of the firearm. The finger rest 58 may be curved concave relative the body bottom side 16 for improved user grip and comfort. The finger rest 58 may have a finger length 58 configured to accommodate a shooter's index and middle fingers.

In use, the rail channel 26 is engaged with the rail system 28 of the firearm. The shooter may than place his or her offhand over the shooting hand with the index and middle fingers on the finger rest 58 and the thumb on the thumb rest 46.

An alternative embodiment of the invention 11 includes the thumb rest 46 coupled directly to the firearm 32. The thumb rest 46 is coupled to a firearm left side 60 or a firearm right side 61 of the firearm. The thumb rest 46 may comprise a plurality of cylindrical thumb extensions 62. The plurality of cylindrical thumb extensions 62 may be three evenly spaced thumb extensions 62.

A finger rest trigger guard 64 is coupled to the firearm 32. The finger rest trigger guard 64 has a trigger guard loop portion 66 coupled to the firearm 32 on either side of a trigger 68 of the firearm and a finger rest portion 70 extending forward from a front section 72 of the trigger guard loop portion. The finger rest portion 70 may have a concave upper rest side 74 for user comfort. A locking safety rail 76 may be coupled to the firearm right side 61 or the firearm left side 60. The locking safety rail 76 is configured to selectively engage the locking channel of the holster.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A handgun offhand finger rest apparatus comprising:

an attachment body having a body top side, a body bottom side, a body left side, a body right side, a body front side, and a body back side, the body top side being configured to be selectively engageable with an underside of a firearm in front of a trigger guard of the firearm;

a thumb rest coupled to the attachment body, the thumb rest perpendicularly extending from either the body left side or the body right side, the thumb rest having a resting surface configured to support a thumb of a user, the resting surface being oriented parallel to a firing direction of the firearm; and a finger rest coupled to the attachment body, the finger rest being coupled to the body bottom side adjacent the body back side and being configured to rest adjacent the trigger guard of the firearm, the finger rest being curved concave relative the body bottom side.

2. The handgun offhand finger rest apparatus of claim 1 further comprising the body top side having a rail channel extending from the body front side to the body back side, the rail channel being configured to selectively engage a rail system of the firearm.

3. The handgun offhand finger rest apparatus of claim 2 further comprising an attachment width and an attachment depth of the attachment body defining an attachment thickness with the rail channel, the attachment thickness being uniform excepting a pair of rail protrusions of the rail channel.

4. A handgun offhand finger rest apparatus comprising:

an attachment body having a body top side, a body bottom side, a body left side, a body right side, a body front side, and a body back side, the body top side being configured to be selectively engageable with an underside of a firearm in front of a trigger guard of the firearm;

a thumb rest coupled to the attachment body, the thumb rest perpendicularly extending from either the body left side or the body right side, the thumb rest having a resting surface configured to support a thumb of a user, the resting surface being oriented parallel to a firing direction of the firearm;

a finger rest coupled to the attachment body, the finger rest being coupled to the body bottom side adjacent the body back side and being configured to rest adjacent the trigger guard of the firearm; and the thumb rest being rectangular prismatic and having rounded edges.

5. The handgun offhand finger rest apparatus of claim 1 further comprising the finger rest having a finger length configured to accommodate a shooter's index and middle fingers.

6. The handgun offhand finger rest apparatus of claim 1 further comprising the thumb rest being configured to slidably engage a locking channel of a holster.

7. The handgun offhand finger rest apparatus of claim 2 further comprising the attachment body having an attachment length configured to conform to a rail length of the rail system of the firearm; the thumb rest having a thumb length equal to at least 75% of the attachment length, the thumb rest being configured to slidably engage a locking channel of a holster.

8. The handgun offhand finger rest apparatus of claim 1 further comprising the attachment body being configured to be bolted to the underside of the firearm.

9. A handgun offhand finger rest apparatus comprising:

an attachment body having a body top side, a body bottom side, a body left side, a body right side, a body front side, and a body back side, the body top side having a rail channel extending from the body front side to the body back side, the rail channel being configured to selectively engage a rail system on an underside of a firearm in front of a trigger guard of the firearm;

a thumb rest coupled to the attachment body, the thumb rest perpendicularly extending from either the body left side or the body right side, the thumb rest being rectangular prismatic and having rounded edges, the thumb rest being configured to slidably engage a locking channel of a holster, the thumb rest having a resting surface configured to support a thumb of a user, the resting surface being oriented parallel to a firing direction of the firearm; and a finger rest coupled to the attachment body, the finger rest being coupled to the body bottom side adjacent the body back side and being configured to rest adjacent the trigger guard of the firearm, the finger rest being curved concave relative the body bottom side, the finger rest having a finger length configured to accommodate a shooter's index and middle fingers.

10. The handgun offhand finger rest apparatus of claim 9 further comprising an attachment width and an attachment depth of the attachment body defining an attachment thickness with the rail channel, the attachment thickness being uniform excepting a pair of rail protrusions of the rail channel.

11. The handgun offhand finger rest apparatus of claim 9 further comprising the attachment body having an attachment length configured to conform to a rail length of the rail system of the firearm; the thumb rest having a thumb length equal to at least 75% of the attachment length.

* * * * *